US008869343B2

(12) United States Patent
Hedlund et al.

(10) Patent No.: US 8,869,343 B2
(45) Date of Patent: Oct. 28, 2014

(54) DETACHABLE DUST RECEPTACLE FOR A VACUUM CLEANER

(75) Inventors: Tomas Hedlund, Västervik (SE); Torkel Ingre, Stockholm (SE)

(73) Assignee: AB Electrolux (SE)

( * ) Notice: Subject to any disclaimer, the term of this patent is extended or adjusted under 35 U.S.C. 154(b) by 410 days.

(21) Appl. No.: 13/319,492

(22) PCT Filed: Apr. 30, 2010

(86) PCT No.: PCT/SE2010/000116

§ 371 (c)(1),
(2), (4) Date: Jan. 23, 2012

(87) PCT Pub. No.: WO2010/128922

PCT Pub. Date: Nov. 11, 2010

(65) Prior Publication Data

US 2012/0131763 A1 May 31, 2012

(30) Foreign Application Priority Data

May 8, 2009 (SE) ..... 0900630

(51) Int. Cl.
*A47L 9/10* (2006.01)
*A47L 9/14* (2006.01)

(52) U.S. Cl.
CPC ..... *A47L 9/1409* (2013.01); *A47L 9/1463* (2013.01)
USPC ..... 15/347; 15/246.2

(58) Field of Classification Search
CPC ..... A47L 5/28; A47L 5/24; A47L 5/26; A47L 5/30; A47L 7/0028; A47L 7/0038; A47L 7/0042; A47L 9/20; A47L 9/1427; A47L 9/1666; A47L 9/1683
USPC ..... 15/246.2, 344, 350, 352, 353, 347
See application file for complete search history.

(56) References Cited

U.S. PATENT DOCUMENTS 4,278,456 A 7/1981 Hug
4,364,757 A 12/1982 Leonatti (Continued)

FOREIGN PATENT DOCUMENTS

DE 3031024 9/1994
EP 1825798 8/2007

(Continued)

OTHER PUBLICATIONS

Office Action, with English translation, for Korean Patent Application No. 10-2014-7012537 dated Aug. 9, 2014.

*Primary Examiner* — Dung Van Nguyen
(74) *Attorney, Agent, or Firm* — RatnerPrestia

(57) ABSTRACT

Disclosed is a detachable dust receptacle for collecting dust in a vacuum cleaner, and a vacuum cleaner equipped with such a receptacle. The dust receptacle comprising an inlet port connectable to a hose joint in the vacuum cleaner for receiving dust-laden air, a suction port, to which a source of vacuum is connectable, a first sealing element arranged for establishing an effective sealing of the inlet port against the hose joint, and a second sealing element arranged for establishing an effective sealing of the suction port against the source of vacuum, wherein at least one of the sealing elements is a lip seal. The dust receptacle can be detached/attached from/to the vacuum cleaner body, irrespective of the direction of the detachment/attachment relative the seal and irrespective of the number of sealing connections used to seal the receptacle to the vacuum cleaner body, without damaging of the sealing element and with maintained sealing effect.

23 Claims, 2 Drawing Sheets

(56) References Cited

U.S. PATENT DOCUMENTS

| | | | | |
|---|---|---|---|---|
| 6,385,810 | B1 | 5/2002 | Lang | |
| 6,818,032 | B2 | 11/2004 | Bilek et al. | |
| 2001/0018865 | A1* | 9/2001 | Wegelin et al. | 95/268 |
| 2004/0034962 | A1* | 2/2004 | Thur et al. | 15/353 |
| 2005/0081325 | A1* | 4/2005 | Park | 15/353 |
| 2005/0229355 | A1* | 10/2005 | Crouch et al. | 15/352 |

FOREIGN PATENT DOCUMENTS

| | | |
|---|---|---|
| JP | 62-117948 | 7/1987 |
| KR | 10-0354653 | 12/2002 |
| WO | WO 95/14422 | 6/1995 |
| WO | WO 00/36964 | 6/2000 |

* cited by examiner

DETACHABLE DUST RECEPTACLE FOR A VACUUM CLEANER

TECHNICAL FIELD

The present invention relates to a detachable dust receptacle for use in a vacuum cleaner, the dust container being sealed to the vacuum cleaner body by means of lip seals, and to a vacuum cleaner which incorporates such a dust receptacle.

BACKGROUND

Bagless vacuum cleaners often use cyclonic separation to separate dirt and dust debris from an airflow. Bagless vacuum cleaners maintain a consistently high level of suction, even as the dust collecting container incorporated into the vacuum cleaner fills with dirt.

A bagless vacuum cleaner is a vacuum cleaner, which instead of utilizing a flexible bag, which may be disposable, for dust collection, uses a reusable container, which may be generally rigid, as compared with a bag.

The absence of a dust bag in the vacuum cleaner can make it difficult to dispose of the dirt and dust which is collected during the vacuuming. This can be solved by employing a removable dust collecting receptacle, which is easily disengaged from the vacuum cleaner body and emptied, and is for example shown in EP 1 825 798.

It is important that the inlet port of the detachable receptacle, which receives dust-laden air from the hose, seals tightly against the hose joint in the vacuum cleaner body, in order not to get leakage of dust debris into the housing of the vacuum cleaner. Further, a tight sealing between the dust receptacle and the source of vacuum is important, otherwise a reduced suction effect of the vacuum cleaner could result.

However, it is not desirable for there to be too tight a fit between the vacuum cleaner and receptacle, since this would make it difficult to easily attach/detach the receptacle to/from the vacuum cleaner body. A small amount of play between the receptacle and the body is hence desirable.

In order to get a tight sealing between a receptacle and a vacuum cleaner body having the necessary play between the two parts, conventional sealing elements, such as O-rings, are used in some prior art solutions. For example the soft-elastic seal used in U.S. Pat. No. 4,278,456 is of O-ring type. Using O-rings, however, it is still important to have a tight fit between the receptacle and the vacuum cleaner body, since the sealing effect of O-rings is highly dependent on the compression pressure.

Upon removal from or insertion of the dust receptacle into the vacuum cleaner body, the sealing element can be subject to great shear stress forces, which may result in wear and a consequent reduced useful life of the sealing element.

In WO0036964 the movement for detaching/attaching one part from another is substantially in the "axial direction" that is, a direction which is substantially normal to an opening in the receptacle, which is to be sealed to the vacuum cleaner body. This is in contrast to the "radial direction," which is understood as a direction which is substantially perpendicular to the axial direction, and extends substantially from the perimeter of the opening and towards the middle of the opening. It is also understood, that the opening may have a planar or non-planar perimeter, and/or that the opening may be symmetrically or asymmetrically shaped. The axial movement in WO0036964 results in a reduced shear stress exerted on the seal during detachment and attachment.

This solution is not a general purpose solution, however, since not all vacuum cleaner constructions enable a detachment/attachment of the receptacle in a direction that is axial to the seal. Also, if the vacuum cleaner construction has more than one sealing connection between the receptacle and the vacuum cleaner body, an axial detachment/attachment of the receptacle relative to every sealing member is not simultaneously possible and thereby deteriorating shear stress forces will be exerted to some of the sealing members during the attachment/detachment.

There is hence a need for a detachable dust receptacle which can be detached/attached from/to the vacuum cleaner body, irrespective of the direction of the detachment/attachment relative the seal and irrespective of the number of sealing connections used to seal the receptacle to the vacuum cleaner body, without damaging the sealing element and with maintained sealing effect.

SUMMARY

It is a general object of the present disclosure to eliminate or alleviate at least some of the disadvantages in prior art solutions.

It is further an object to provide a detachable dust receptacle for use in a vacuum cleaner, the dust container being sealed to the vacuum cleaner body by means of sealing elements, and to a vacuum cleaner incorporating such a receptacle.

More specific objects include providing a detachable dust receptacle which can be detached/attached from/to the vacuum cleaner body, irrespective of the direction of the detachment/attachment relative the seal and irrespective of the number of sealing connections used to seal the receptacle to the vacuum cleaner body, with reduced likelihood of damaging or without damaging the sealing element, and with maintained sealing effect.

The invention is defined by the appended independent claims. Embodiments are set forth in the appended dependent claims and in the following description and drawings.

According to a first aspect, this object is achieved by a detachable dust receptacle for collecting dust in a vacuum cleaner, comprising an inlet port connectable to a hose joint in the vacuum cleaner for receiving dust-laden air, a suction port, to which a source of vacuum is connectable, a first sealing element arranged for establishing an effective sealing of the inlet port against the hose joint, and a second sealing element arranged for establishing an effective sealing of the suction port against the source of vacuum, wherein at least one of the sealing elements is a lip seal.

By an "effective sealing" is meant a sealing which maintains the negative pressure in the dust receptacle. An effective sealing is both essentially air tight and essentially dust tight.

The invention is particularly useful in a bagless vacuum cleaner.

The lip seal is sealingly engageable with the opposite surface. Unlike O-rings, whose sealing effect is highly dependent on an axial compression pressure between the receptacle and the cover, the flexibly compressible lip of the lip seal has a self-sealing function. During operation of the vacuum cleaner, the lip seal between the receptacle and the cover is drawn radially inwards towards the opening between the cover and the receptacle by the vacuum formed in the vacuum cleaner. Simultaneously, a part of the seal exerts a sealing axial force against the opposite surface. This results in a sealing effect which increases the larger the difference in pressure between the inside and the outside of the receptacle becomes. Due to the flexibility and extent of the lip seal, it is not necessary to provide tolerances against the opposite surface that are as close as with other kinds of seals, for example O-rings. The lip seal gives an effective sealing between the receptacle and the vacuum cleaner body even though there is a small play between the two parts, the play being necessary for an easy detachment/attachment of the two parts. Thereby, the lip seal manages shear stress better than other kinds of sealing.

In some prior art solutions a hatch cover is used in order to get an effective sealing between the inlet of the receptacle and the hose joint of the vacuum cleaner. Using a lip seal as the sealing element, the hose joint may be coupled directly to the inlet port without utilization of a hatch cover, yet resulting in an effective sealing.

In one embodiment, the first sealing element is a lip seal. The lip seal may be attached at the inlet port of the receptacle. It may alternatively be attached at the hose joint in the vacuum cleaner.

In one embodiment, the second sealing element is a lip seal. The lip seal may be attached at the suction port of the receptacle. It may equally well be attached at the source of vacuum in the vacuum cleaner.

Both the first and the second sealing elements may be lip seals.

The inlet port and the suction port of the receptacle may be located at substantially opposite sides of the receptacle.

In one embodiment, the flow area cross-section of the inlet port and/or the suction port may be in a plane which is inclined between about 60 and about 0 degrees with respect to a direction in which the receptacle is arranged to be extractable from the vacuum cleaner. This plane may be inclined outwardly. It could also be inclined inwardly.

Planes associated with both the inlet port and the suction port may be inclined. In one embodiment, both planes may be outwardly inclined. In yet an alternative embodiment, one of the inlet port and the suction port is inwardly inclined and the other one is outwardly inclined, the outwardly inclined port being more inclined than the inwardly inclined port. Inclined planes facilitate the extraction of the receptacle from the vacuum cleaner body.

The lip seal may be attached by using glue, by pressing/squeezing the base of the lip seal into a slot or by snapping it into place using protuberances, ridges or grooves arranged on the lip base.

In one embodiment the base member of the lip seal is provided with at least one longitudinal ridge, which may facilitate the attachment of the lip seal in a slot in the receptacle or in the cover and keep the lip seal in place.

The lip seal may be made of resiliently compressible material, such as rubber or rubber-like material.

The lip of the lip seal is a sealing flange extending from a base member of the lip seal. The flange may have a substantially convex part which is arranged to sealingly engage against an opposite surface.

According to a second aspect, this object is achieved by a vacuum cleaner equipped with a detachable dust receptacle for collecting dust, as described above.

The dust receptacle may be arranged to be attached to/detached from said vacuum cleaner in a direction which is essentially perpendicular to an imaginary line between the inlet port and the suction port.

DETAILED DESCRIPTION

Figure 1:
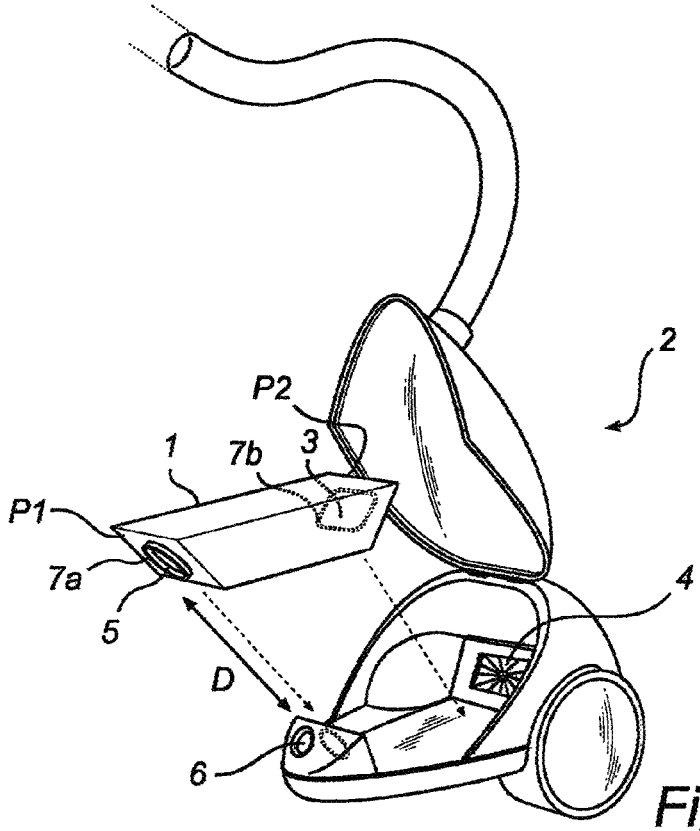
FIG. 1 shows a detachable dust receptacle being attached to a bagless vacuum cleaner.

Referring to the figures, a detachable dust receptacle 1 for use in a vacuum cleaner 2 has a suction port 3 to which a source of vacuum 4 is applied when the dust receptacle 1 is located within the vacuum cleaner 2, and a vacuum is drawn through the suction port 3 and the inlet port 5, FIG. 1. The inlet port 5 is connected to a hose joint 6 for receiving dust-laden air. A first sealing element, a lip seal 7*a*, is arranged for establishing an effective sealing of the inlet port 5 against said hose joint 6. A second sealing element, which also may be a lip seal 7*b* is also arranged between the suction port 3 and the source of vacuum 4 for establishing an effective sealing. The first lip seal could either be attached to the inlet port 5 of the receptacle 1 or to the hose joint 6 of the vacuum cleaner 2. The second lip seal could be attached to the suction port 3 or to the motor cover 8 covering the source of vacuum 4, FIG. 3.

The inlet port 5 and the suction port 3 may be formed at substantially opposite sides of the receptacle 1. However, the location of the inlet port 5 and the suction port 3 may have any configuration which matches with the vacuum cleaner 2 in question.

A flow area cross-section of the inlet port 5 and/or the suction port 3 is in a plane P1, P2, respectively, which may be inclined at an angle a1, a2, respectively, with respect to a direction D in which the receptacle 1 is arranged to be extractable from the vacuum cleaner 2, FIG. 1. These inclinations may be between 60 and 0 degrees, but angles greater than 60 degrees may be used in other embodiments.

The term "outwardly" here means that a normal direction of the plane, at the outside of the container, points obliquely downwardly when the container is held in a substantially horizontal position.

In one embodiment, one of the planes P1, P2 may be outwardly inclined, while the other one is substantially straight.

In another embodiment, both planes P1, P2 are outwardly inclined.

In yet another embodiment, one of the planes P1, P2 may be inwardly inclined, while the other plane is outwardly inclined. In such an embodiment, the outwardly inclined plane may have a greater angle of inclination than the inwardly inclined plane.

Figure 2:
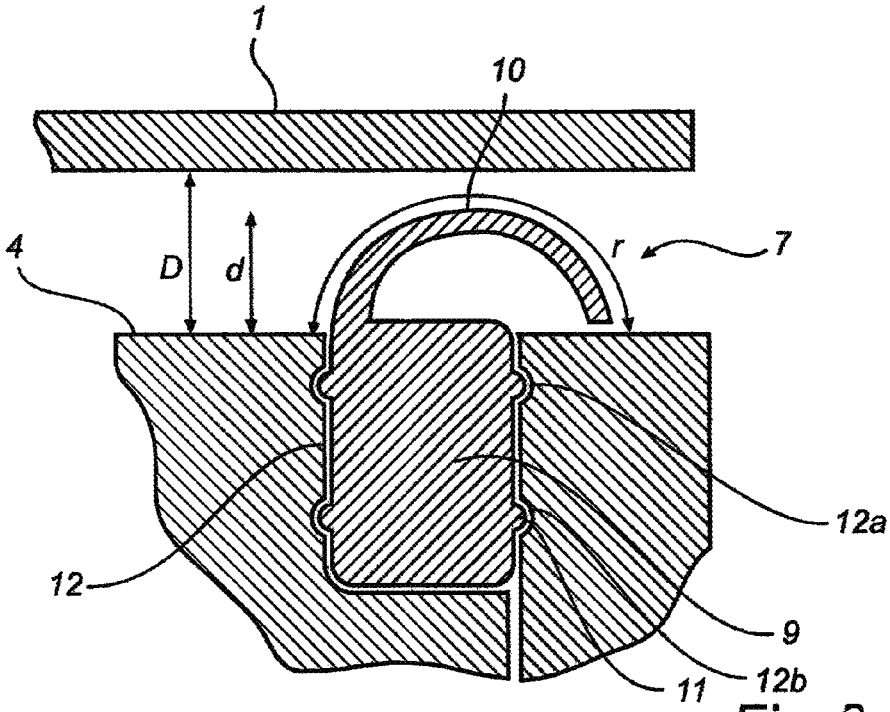
FIG. 2 shows a cross section of an embodiment of the lip seal.
Figure 3:
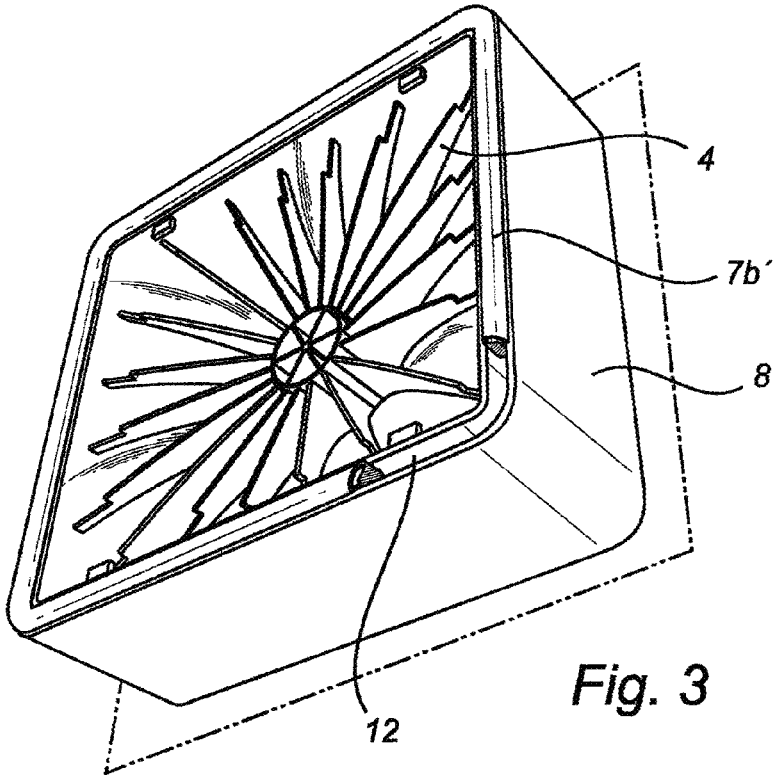
FIG. 3 shows the lip seal being attached to the motor cover.
Figure 4:
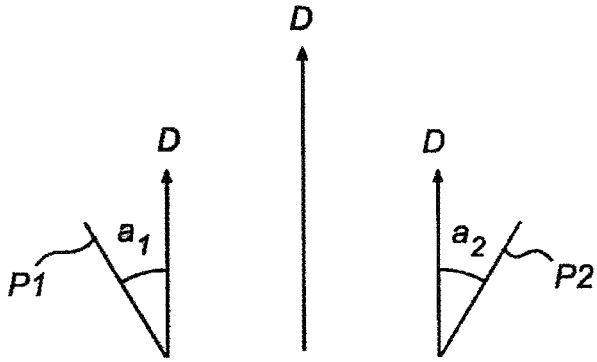
FIG. 4 is a schematic diagram illustrating angles of the inlet port (to the left) and the suction port (to the right).

In FIG. 2, an embodiment of the profile of the lip seal 7 is shown and is to be regarded as a non-limiting example. The lip seal 7 consists of a base member 9 and a flexible and compressible lip member 10 extending from the base member 9, where the lip member 10 is sealingly engageable with the opposite surface. The base 9 of the lip seal 7 is of generally square or rectangular shape. The base member 7 may be substantially symmetric. One, two, three or more longitudinal ridges 11 or grooves on the base member 9 may be provided to facilitate the attachment of the lip seal 7 in a slot 12 in the receptacle 1 or in the vacuum cleaner body 2, and keep the lip seal 7 in place in the slot. The ridges 9 may interact with one or more grooves 12*a*, 12*b* to provide a positive interlocking effect, thus keeping the lip seal 4 securely in place. FIG. 3. The lip seal 7*b*, 7*b*' may also be fastened to the receptacle 1 or to the vacuum cleaner body 2 by using glue. The slot 12 may, as illustrated, be formed by two separately formed parts, which when joined together provides a press fit for the base 9 of the lip seal 7.

The lip member 10 may be a sealing flange, which may have a convex part arranged to sealingly abut against the opposite surface, upon being subjected to an underpressure.

This characteristics of the lip seal 7 helps provide an effective sealing between the two parts 1, 2 while providing the necessary play between the two parts 1, 2 to provide easy attachment/detachment of the receptacle 1.

The sealing flange may be substantially arc-shaped but may equally well be straight. The flange could be of constant or varying thickness. It may extend from the side of the base member 9 or from the top of the same. It may be longer than the width of the base member 9 but it may also be shorter. The flange may extend beyond the side of the base member 9 opposing the attachment side.

The person skilled in the art realises that the present invention by no means is limited to the embodiments described above. On the contrary, many modifications and variations are possible within the scope of the appended claims.

For example the base 9 and the lip 10 of the lip seal 7 do not have to be made of the same material and could exhibit different qualities. It is recognized that the lip seal 7 may be designed to allow smaller or larger tolerances, e.g. by varying the axial and/or radial length, the thickness, cross section geometry and the material of the lip 10.

The lip member 10 may be designed, in its non-compressed state, to have an extent in the axial direction, which is larger than a largest permitted distance D between the receptacle 1 and the vacuum cleaner body 2. In various embodiments, the lip member 10 may extend 5%, 10%, 15%, 20%, 25%, 30%, 50%, 75%, 100%, 150%, 200% or 300% beyond that distance. Alternatively, or as a complement, a length r of the lip member 10, along a face that is to engage the opposing part, may be 5%, 10%, 15%, 20%, 25%, 30%, 50%, 75%, 100%, 150%, 200%, 300%, 400% or 500% longer than said distance.

The invention claimed is:

1. A detachable dust receptacle for collecting dust in a vacuum cleaner, the receptacle comprising;

an inlet port connectable to a hose joint in said vacuum cleaner for receiving dust-laden air; a suction port, to which a source of vacuum is connectable;

a first sealing element arranged for establishing an effective sealing of said inlet port against said hose joint;

and a second sealing element arranged for establishing an effective sealing of said suction port against said source of vacuum, characterized in that at least one of said sealing elements is a lip seal;

wherein said inlet port and said suction art are located at substantialt opposite sides of said receptacle.

2. The detachable dust receptacle according to claim 1, wherein said first sealing element is a lip seal.

3. The detachable dust receptacle according to claim 1, wherein said second sealing element is a lip seal.

4. The detachable dust receptacle according to claim 1, wherein a flow area cross-section of said inlet port and/or said suction port is in a plane which is inclined between about 60 and about 0 degrees with respect to a direction in which said receptacle is arranged to be extractable from said vacuum cleaner.

5. The detachable dust receptacle according to claim 4, wherein said plane is inclined less than about 60 degrees, or less than about 50 degrees, or less than about 40 degrees, or less than about 30 degrees, or less than about 20 degrees, or less than about 10 degrees, or less than about 5 degrees, or less than about 1 degree.

6. The detachable dust receptacle according to claim 4, wherein said plane is outwardly inclined.

7. The detachable dust receptacle according to claim 4, wherein said plane is inwardly inclined.

8. The detachable dust receptacle according to claim 4, wherein said planes associated with both said inlet port and said suction port are inclined.

9. The detachable dust receptacle according to claim 8, wherein both said inlet port and said suction port are outwardly inclined.

10. The detachable dust receptacle according to claim 8, wherein a plane associated with one of said inlet port and said suction port is inwardly inclined and the other one is outwardly inclined, said outwardly inclined port being more inclined than said inwardly inclined port.

11. The detachable dust receptacle according to claim 1, wherein a base of said lip seal is attached by using glue, by pressing/squeezing said base of said lip seal into a slot or by snapping it into place using protuberances or at least one longitudinal ridge on said lip base.

12. The detachable dust receptacle according to claim 1, wherein the lip of said lip seal is a sealing flange extending from a base member of said lip seal, said flange having a convex part which is arranged to sealingly engage against an opposite surface.

13. A vacuum cleaner equipped with a detachable dust receptacle for collecting dust, as described in claim 1.

14. The vacuum cleaner according to claim 13, wherein the dust receptacle is arranged to be attached to/detached from said vacuum cleaner in a direction which is substantially perpendicular to an imaginary line between the inlet port and the suction port.

15. A detachable dust receptacle for collecting dust in a vacuum cleaner, the receptacle comprising:

an inlet port connectable to a hose joint in said vacuum cleaner for receiving dust-laden air;

a suction port connectable to a source of vacuum;

a first sealing element arranged for establishing an effective sealing of said inlet port against said hose joint;

and a second sealing element arranged for establishing an effective sealing of said suction port against said source of vacuum;

wherein at least one of said sealing elements is a lip seal; and wherein a flow area cross-section of said inlet port and/or said suction port is in a plane which is inclined between about 60 and about 0 degrees with respect to a direction in which said receptacle is arranged to be extractable from said vacuum cleaner.

16. A detachable dust receptacle for collecting dust in a vacuum cleaner, the receptacle comprising:

an inlet port connectable to a hose joint in said vacuum cleaner for receiving dust-laden air;

a suction port connectable to a source of vacuum;

a first sealing element arranged for establishing an effective sealing of said inlet port against said hose joint;

and a second sealing element arranged for establishing an effective sealing of said suction port against said source of vacuum;

wherein at least one of said sealing elements is a lip seal, and a base of said lip seal is attached by using glue, by pressing/squeezing said base of said lip seal into a slot or by snapping it into place using protuberances or at least one longitudinal ridge on said lip base.

17. The detachable dust receptacle of claim 16, wherein said inlet port and said suction port are located at substantially opposite sides of said receptacle.

18. The detachable dust receptacle of claim 16, wherein a flow area cross-section of said inlet port and/or said suction port is in a plane which is inclined between about 60 and about 0 degrees with respect to a direction in which said receptacle is arranged to be extractable from said vacuum cleaner.

19. The detachable dust receptacle of claim 16, wherein the lip of said lip seal is a sealing flange extending from a base member of said lip seal, said flange having a convex part which is arranged to sealingly engage against an opposite surface.

20. A detachable dust receptacle for collecting dust in a vacuum cleaner, the receptacle comprising:

an inlet port connectable to a hose joint in said vacuum cleaner for receiving dust-laden air;

a suction port connectable to a source of vacuum;

a first sealing element arranged for establishing an effective sealing of said inlet port against said hose joint;

and a second sealing element arranged for establishing an effective sealing of said suction port against said source of vacuum;

wherein at least one of said sealing elements is a lip seal;

wherein the lip of said lip seal is a sealing flange extending from a base member of said lip seal, said flange having a convex part which is arranged to sealingly engage against an opposite surface.

21. The detachable dust receptacle of claim 20, wherein said first sealing element is a lip seal.

22. The detachable dust receptacle of claim 20, wherein said second sealing element is a lip seal.

23. The detachable dust receptacle of claim 20, wherein a flow area cross-section of said inlet port and/or said suction port is in a plane which is inclined between about 60 and about 0 degrees with respect to a direction in which said receptacle is arranged to be extractable from said vacuum cleaner.

* * * * *

UNITED STATES PATENT AND TRADEMARK OFFICE

CERTIFICATE OF CORRECTION

PATENT NO. : 8,869,343 B2
APPLICATION NO. : 13/319492
DATED : October 28, 2014
INVENTOR(S) : Tomas Hedlund and Torkel Ingre It is certified that error appears in the above-identified patent and that said Letters Patent is hereby corrected as shown below:

In the Claims:

Claim 1, column 5, line 53, delete “art” and insert --port--
Claim 1, column 5, line 54, delete “substantialt” and insert --substantially--

Signed and Sealed this
Seventeenth Day of February, 2015

Michelle K. Lee

Michelle K. Lee
*Deputy Director of the United States Patent and Trademark Office*